US007515171B2

(12) United States Patent
Lim

(10) Patent No.: US 7,515,171 B2
(45) Date of Patent: Apr. 7, 2009

(54) LIGHT SCANNING MODULE HAVING CLEANING SHUTTER TO CLEAN LASER SCANNING WINDOW AND IMAGE FORMING APPARATUS HAVING THE SAME

(75) Inventor: Kyung-min Lim, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 12/013,675

(22) Filed: Jan. 14, 2008

(65) Prior Publication Data

US 2008/0187350 A1 Aug. 7, 2008

(30) Foreign Application Priority Data

Feb. 6, 2007 (KR) ..... 10-2007-0012219

(51) Int. Cl.
*B41J 2/435* (2006.01)
*G03G 21/00* (2006.01)

(52) U.S. Cl. ..... 347/263; 399/98

(58) Field of Classification Search ..... 347/136, 347/152, 242, 245, 257, 263; 399/98, 99
See application file for complete search history.

(56) References Cited

U.S. PATENT DOCUMENTS 5,689,769 A * 11/1997 Appel et al. ..... 399/98
7,203,444 B2 * 4/2007 Yamazaki ..... 399/98
7,277,655 B2 * 10/2007 Namba ..... 399/98
7,330,295 B2 * 2/2008 Sowa et al. ..... 359/212
7,352,377 B2 * 4/2008 Matsutomo ..... 347/136

FOREIGN PATENT DOCUMENTS

| | | |
|---|---|---|
| JP | 2001-253112 | 9/2001 |
| JP | 2005-246901 | 9/2005 |
| JP | 2005-329622 | 12/2005 |
| KR | 1998-56625 | 10/1998 |
| KR | 2005-108058 | 11/2005 |

* cited by examiner

*Primary Examiner*—Hai C Pham
(74) *Attorney, Agent, or Firm*—Stanzione & Kim, LLP

(57) ABSTRACT

A light scanning module mounted to a main body, the module including a light scanning unit including a light scanning window to scan a light onto a photosensitive body of the main body, a cleaning shutter part including a cleaning part to clean the light scanning window and is coupled to the main body to move between an opening position to open the light scanning window and a closing position to close the light scanning window, and the cleaning shutter part, including a cleaning part accommodating part to accommodate at least one area of the cleaning part to pivotally rotate, and a rotation regulating part provided on one side of the cleaning part and is contact-supported on an internal wall of the cleaning part accommodating part to block the pivotal rotation of the cleaning part if the cleaning shutter part moves from the closing position to the opening position, and is separated from the internal wall of the cleaning part accommodating part to permit the pivotal rotation of the cleaning part if the cleaning shutter part moves from the opening position to the closing position.

18 Claims, 16 Drawing Sheets

LIGHT SCANNING MODULE HAVING CLEANING SHUTTER TO CLEAN LASER SCANNING WINDOW AND IMAGE FORMING APPARATUS HAVING THE SAME

CROSS-REFERENCE TO RELATED APPLICATIONS

This application claims priority under 25 U.S.C. § 119(a) from Korean Patent Application No. 10-2007-0012219, filed on Feb. 6, 2007 in the Korean Intellectual Property Office, the disclosure of which is incorporated herein in its entirety by reference.

BACKGROUND OF THE INVENTION

1. Field of the Invention

The present general inventive concept relates to a light scanning module and an image forming apparatus having the same, and more particularly, to a light scanning unit having an improved configuration to clean a light scanning window thereof and an image forming apparatus having the same.

2. Description of the Related Art

A conventional image forming apparatus prints an image on a printing medium corresponding to a printing signal applied from a host apparatus. The image forming apparatus is provided as a printer which prints the image data on the printing medium to be visible, a facsimile which transmits the image data to an external apparatus, a photocopier which copies the image data on plural printing media, and a multi-functional printer which includes the above-described functions.

The conventional image forming apparatus generally comprises a feeding part which stores a printing medium, an image forming part which forms an image on a printing medium fed from the feeding part, and a discharging part which discharges the printing medium on which the image is formed to the outside. Here, the image forming part comprises a developing unit having a photosensitive body which spreads developer onto the printing medium, and a light scanning unit which scans a beam onto the photosensitive body to form an electrostatic latent image thereon. The light scanning unit comprises a light source which generates light, a casing which accommodates the light source, and a light scanning window which is provided in the casing for the beam to penetrate to the photosensitive body.

Here, the image forming apparatus may experience a situation where the developer separated from the photosensitive body is not spread onto the printing medium to be scattered in the inside of the main body while forming the image on the printing medium. If the developer scattered inside the main body, dust of the printing medium, and other foreign substances are adhered to the light scanning window of the light scanning unit, an optical route is interfered, to thereby depreciate a printing quality. Accordingly, the image forming apparatus is required to clean the foreign substance spread on the light scanning window.

In Japanese First Patent Publication 2005-329622, is disclosed a configuration to clean the foreign substance of the light scanning window. As illustrated in FIGS. 1A and 1B, the configuration to clean the conventional light scanning window disclosed in the publication comprises a cleaning shutter 30 which is provided on an upper side of the light scanning unit casing 20 and moves between a closing position for closing the light scanning window 21 and an opening position for opening the light scanning window 21 to clean a light scanning window 21 according to a driving of a driving part (not illustrated). Also, the cleaning shutter 30 comprises a cleaning member 33 which moves and contacts with the light scanning window 21 to clean the light scanning window 21. The cleaning member 33 may be disposed within a cleaning member holding part 31.

However, the conventional cleaning shutter 30 has a problem that a large frictional force between the light scanning window 21 and the cleaning member 33 resists the driving force of the driving part (not illustrated) to slow down a returning speed of the cleaning shutter 30 if the cleaning shutter 30 moves from the opening position to the closing position when a frictional force generated by contact between the cleaning member 33 and the light scanning window 21 is provided to be large so as to improve a cleaning efficiency.

Furthermore, a cleaning efficiency problem occurs when reducing the frictional force between the light scanning window 21 and the cleaning member 33, during the time when the cleaning shutter 30 moves from the closing position to the opening position to solve the above problem.

SUMMARY OF THE INVENTION

The present general inventive concept provides a light scanning module which has an improved configuration of a cleaning shutter so that frictional force between a cleaning member and a light scanning window can differently operate when the cleaning shutter moves from an opening position to a closing position and from the closing position to the opening position, and an image forming apparatus having the same.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a light scanning module which is mounted to a main body, the module including a light scanning unit which has a light scanning window and scans a light onto a photosensitive body of the main body a cleaning shutter part which has a cleaning part to clean the light scanning window and is coupled to the main body to move between an opening position to open the light scanning window and a closing position to close the light scanning window, and the cleaning shutter part, including a cleaning part accommodating part to accommodate at least one area of the cleaning part to pivotally rotate, and a rotation regulating part which is provided on one side of the cleaning part and is contact-supported on an internal wall of the cleaning part accommodating part to block the pivotal rotation of the cleaning part if the cleaning shutter part moves from the closing position to the opening position, and is separated from the internal wall of the cleaning part accommodating part to permit the rotation of the cleaning part if the cleaning shutter part moves from the opening position to the closing position.

The cleaning part may include a cleaning part main body of which one area is rotatably accommodated in the cleaning part accommodating part; and a cleaning member which is provided in a lower part of the cleaning part main body and is interfered with the light scanning window to clean a surface of the light scanning window.

The rotation regulating part may include a rotating shaft which is provided in the cleaning part main body and accommodated in the cleaning part accommodating part, and a supporting projection which is projected in an area of a radiating direction of the rotating shaft, and is contacted with and separated from the internal wall of the cleaning part accommodating part according to the movement of the cleaning shutter part.

The cleaning part main body and the rotating shaft may be provided to be integrated with each other.

The supporting projection may be provided to have a length to contact with an opposite wall of the cleaning part accommodating part so that an angle in which a rotation of the rotational shaft is permitted from a position where the rotational shaft is rotation-blocked by the supporting projection is 90° or less.

The cleaning part accommodating part may include an opening which exposes the cleaning member.

The cleaning member may be provided as one of a sponge, a brush, a fiber, and an elastic member.

The light scanning unit may include a cleaning rib which contacts with the cleaning member and cleans the cleaning member if the cleaning shutter part is in the closing position.

The cleaning rib may be disposed in a diagonal direction with respect to the moving direction of the cleaning shutter.

The cleaning rib may be provided plurally, and the interval among the plural cleaning ribs is provided so that a line according to the moving direction of the cleaning shutter can be on a line linking an end part of a first cleaning rib and an opposite end part of a second cleaning rib adjacent to the first cleaning rib.

The cleaning rib may be provided to be parallel or transverse with respect to the moving direction of the cleaning shutter.

The foregoing and/or other aspects and utilities of the present general inventive concept may also be achieved by providing an image forming apparatus, including a main body, an image forming part which is provided in the main body and has a photosensitive body spreading developer on a printing medium, a light scanning module which scans a light onto the photosensitive body, and a feeding part to feed a printing medium to the image forming part.

The main body may include a driving part to apply a driving force to the cleaning shutter so that the cleaning shutter can move between the opening position and the closing position.

The driving part may include a rotation driving part to transmit a driving force generated in the driving force generating part, and a movement converting part to convert the rotating movement of the rotation driving part into a linear movement of the cleaning shutter.

The rotation driving part may be provided as a gear, and the movement converting part may be provided as a gear stud which is coupled to the rotation driving part and contact-pressurizes the cleaning shutter.

The main body may include a casing, and a door which is provided in the casing to pivotally rotate, and the cleaning shutter is coupled to the door so as to move between the opening position and the closing position in engagement with the rotating movement of the door.

The image forming apparatus may further include a link member which is provided between the door and the cleaning shutter and may convert the rotating movement of the door into a linear movement of the cleaning shutter.

The light scanning unit may include a cleaning rib to contact with the cleaning member and to clean the cleaning member if the cleaning shutter part is in the closing position.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1A:
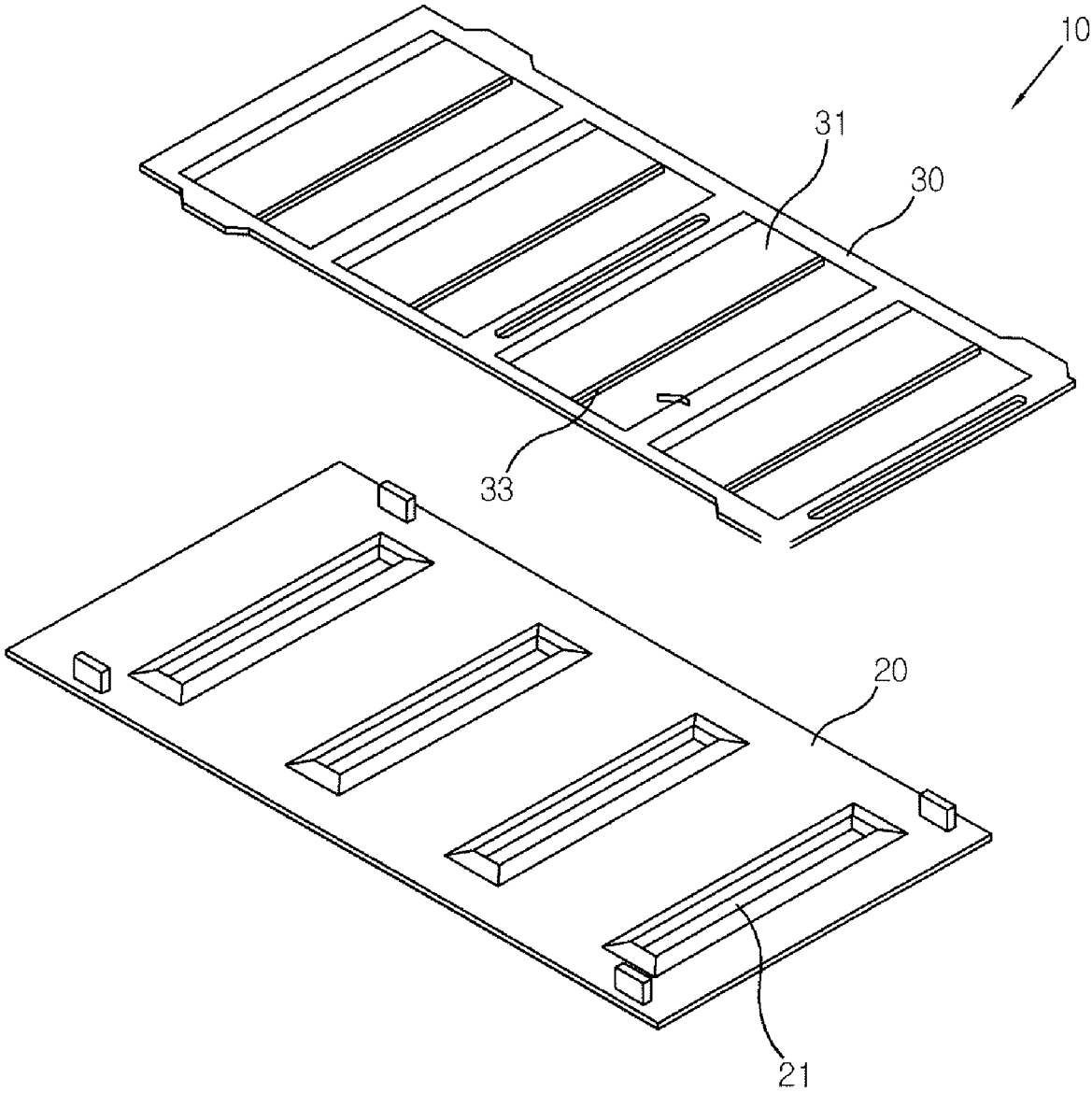
FIG. 1A (RELATED ART)
FIGS. 1A and 1B are schematic views illustrating a configuration to clean a light scanning window of a conventional image forming apparatus.
Figure 1B:
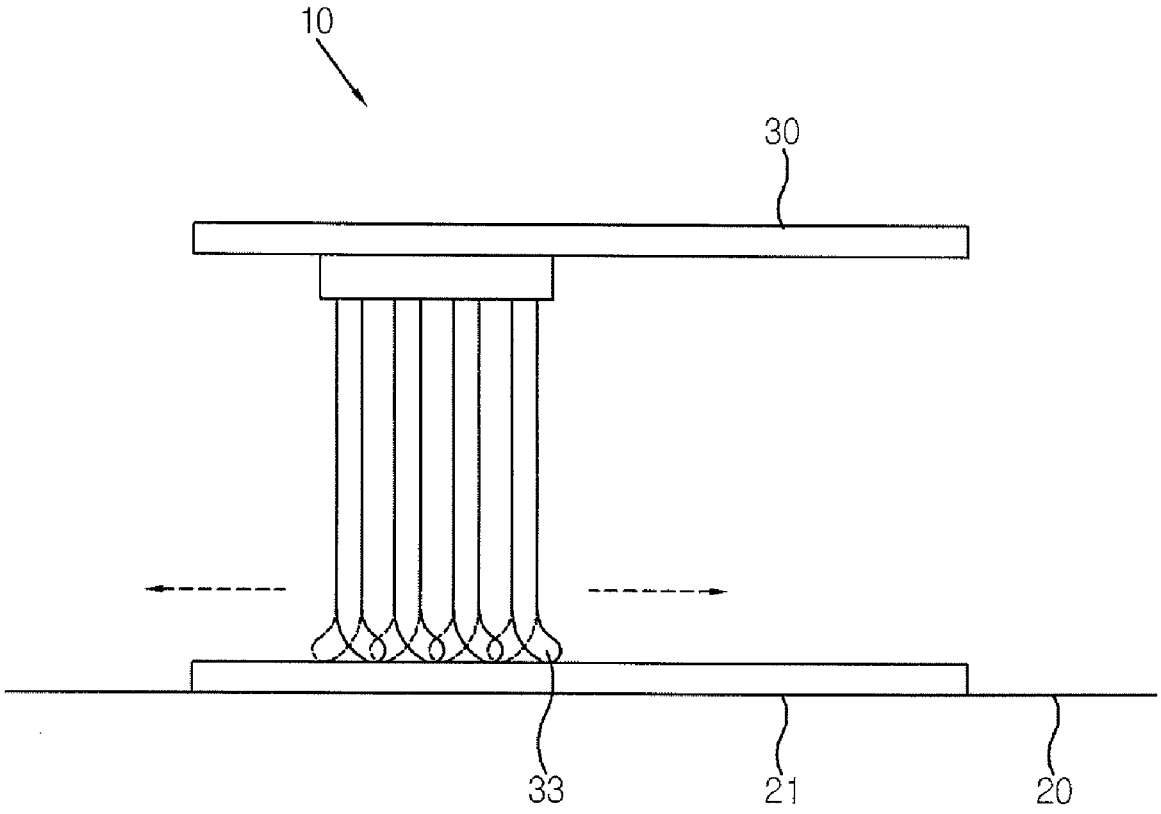
FIG. 1B (RELATED ART)

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 2:
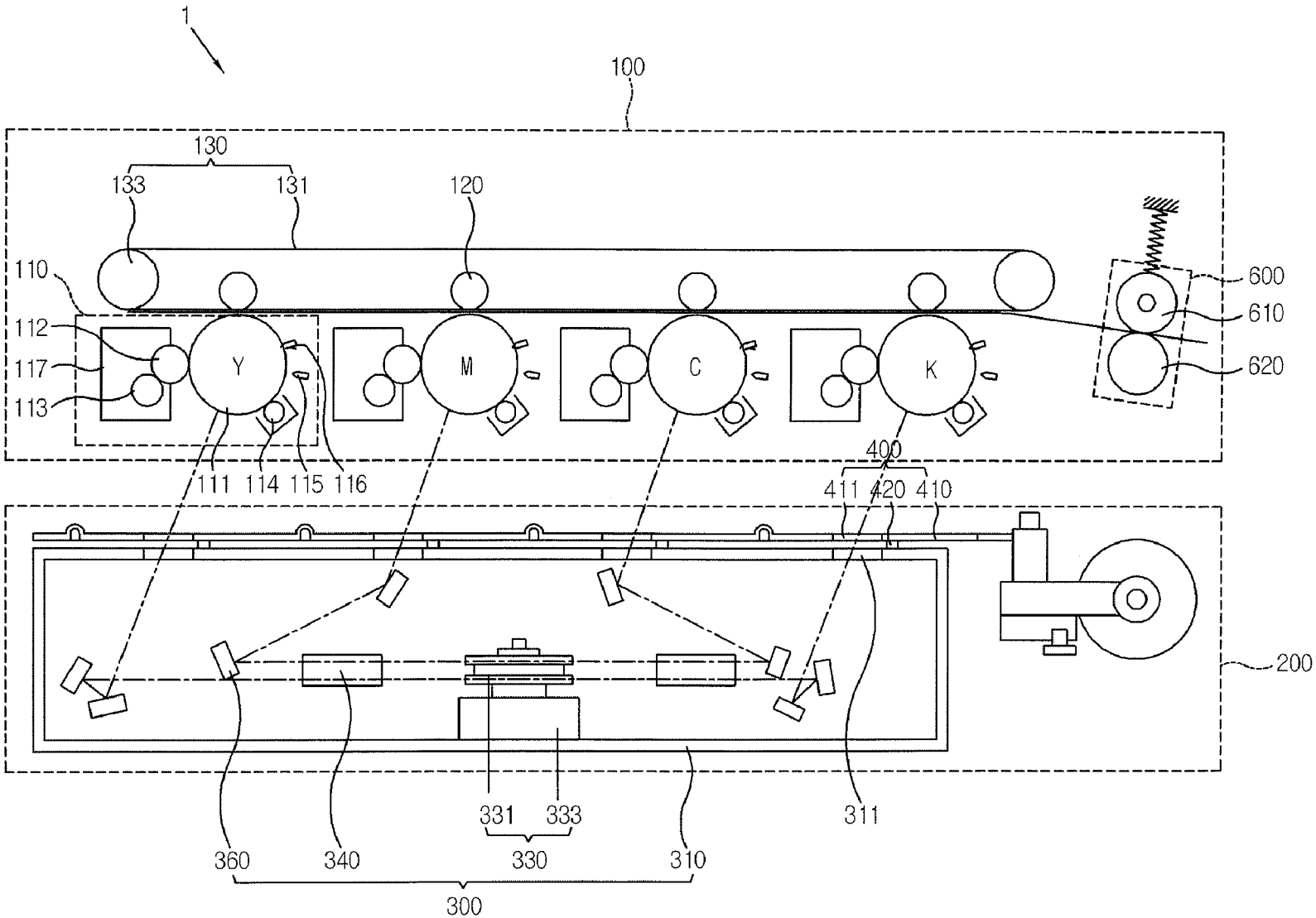
FIG. 2 is a schematic view illustrating a configuration of an image forming apparatus according to an embodiment of the present general inventive concept.
Figure 3:
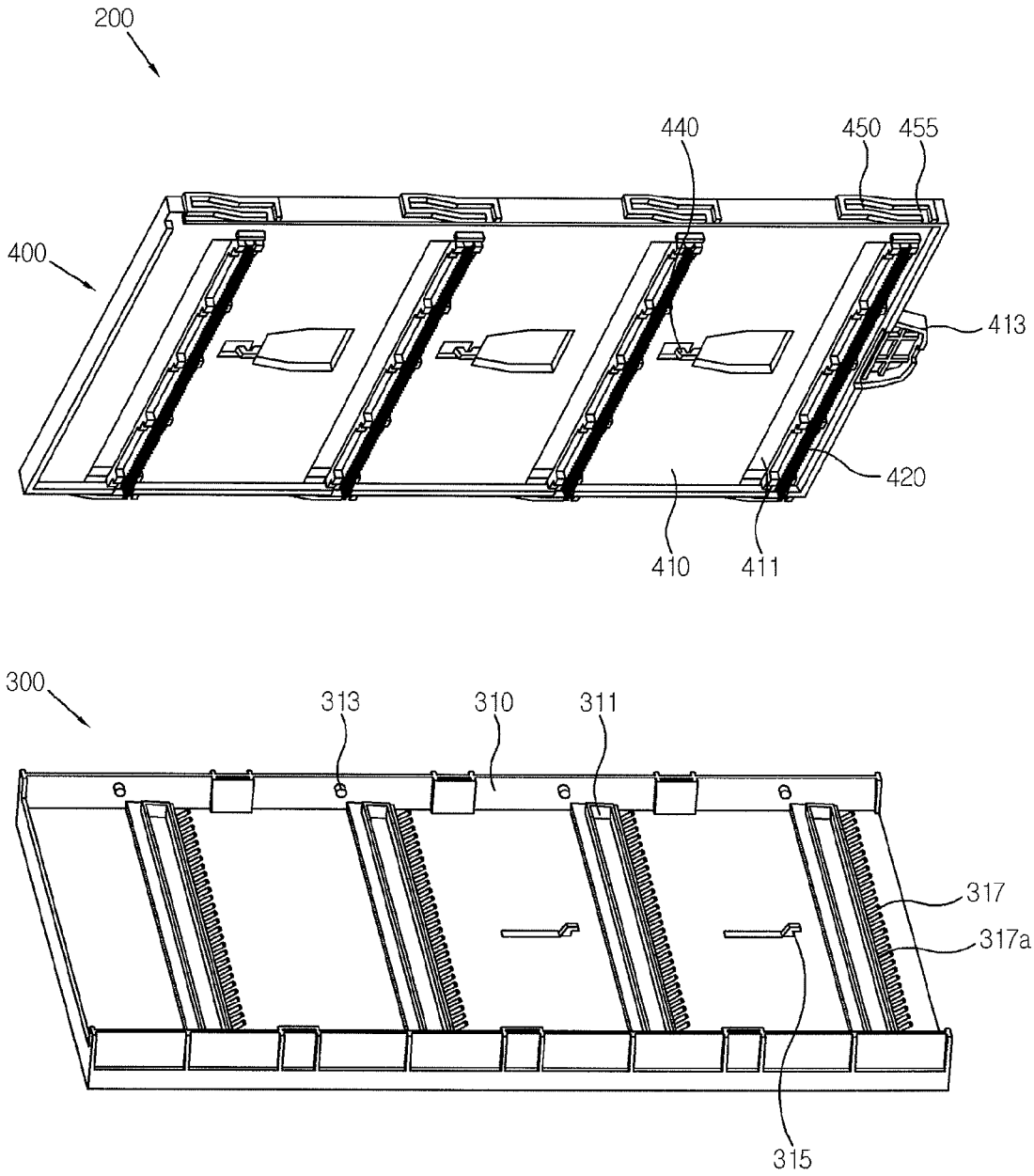
FIG. 3 is an exploded perspective view illustrating a configuration of an exposure part according to an embodiment of the present general inventive concept.

FIG. 2 is a schematic view illustrating a configuration of an image forming apparatus 1 according to an embodiment of the present general inventive concept, and FIG. 3 is a schematic view illustrating a configuration of an exposure part 200 according to an embodiment of the present general inventive concept.

As illustrated in FIGS. 2 and 3, the image forming apparatus 1, according to an embodiment of the present general inventive concept, comprises a feeding part (not illustrated) to feed a printing medium, an image forming part 100 to form an image on the printing medium, an exposure part 200 to form an electrostatic latent image on a photosensitive body 111 of the image forming apparatus 100, and a fusing part 600 to apply heat and pressure to the printing medium on which developer is spread to fuse the developer to the printing medium. The fusing part 600 can include a heating roller 620 to apply the heat and a pressing roller 610 to apply the pressure.

The image forming part 100 spreads developer on the printing medium to form an image thereon. The image forming part 100 may be classified into a mono type in which a black-and-white image is formed, and a color type in which a color image is formed by using four colors of developer such as yellow Y, magenta M, cyan C and black B. Also, the color type image forming part 100 can be classified into a single-pass type which has a light scanning unit 300 corresponding to a number of the photosensitive body 111, and a multi-pass type which has a smaller number of light scanning units 300 than a number of photosensitive bodies 111.

The image forming part 100 according to an exemplary embodiment of the present general inventive concept will be described as a single-pass type, but may be provided in other types. The image forming part 100 comprises a developing unit 110 to spread developer to a printing medium, a transfer roller 120 to apply a transfer voltage to the printing medium to transfer the developer on a surface of the photosensitive body 111 to the printing medium, and a printing medium transfer belt part 130 to transfer the printing medium to the developing unit 110 and the transfer roller 120.

The developing unit 110 comprises the photosensitive body 111 on which the developer is spread, an electrifying roller 114 to electrify a surface of the photosensitive body 111 to a predetermined electric potential, a developer transfer body 112 to supply the developer to the photosensitive body 111, a developer storing part 117 to store the developer, a supplying roller 113 to supply the developer in the developer storing part 117 to the developer transfer body 112, a cleaning member 116 to clean developer remaining on the surface of the photosensitive body 111 having transferred the developer to the printing medium, and a static electricity cleaning part 115 to uniformly clean the electric potential on the surface of the photosensitive body 111.

The developing unit 110 is provided plurally according to various colors of the developer stored in its inside. That is, the developing unit 110 is provided plurally to have four colors, such as yellow Y, magenta M, cyan C, and black B. A description of a configuration of the developing unit will be omitted as it is the same as the conventional configuration.

The transfer roller 120 applies a predetermined transfer voltage on a rear surface of the printing medium transferred to a printing medium transfer belt 131 to enable the developer spread on the photosensitive body 111 to be transferred on a surface of the printing medium. The transfer roller 120 applies a voltage of a polarity opposite to a polarity of the developer to enable the developer to be separated from the photosensitive body 111 to be transferred to the printing medium.

The printing medium transfer belt part 130 comprises a printing medium transfer belt 131 to attach the printing medium on its surface by using static electricity and to sequentially transfer the printing medium to each of the developing units 110, and a driving roller 133 to drive the printing medium transfer belt 131.

The exposure part 200 according to an embodiment of the present general inventive concept comprises the light scanning unit 300 to scan a beam to the photosensitive body 111 of each of the developing units 110 to form an electrostatic latent image on the surface of the photosensitive body 111, and a cleaning shutter part 400 which is provided on one side of the light scanning unit 300 to clean a light scanning window 311 of the light scanning unit 300.

The light scanning unit 300 comprises a light source part (not illustrated) to generate a light, a polygon mirror assembly 330, a reflection mirror 360, a plurality of optical holes 340 and a casing 310 to support the above components. The light source part (not illustrated) comprises a light source (not illustrated) to generate and scan a light and a regulating lens (not illustrated) to regulate the scanned light source (not illustrated) to be parallel with an optical axis. The polygon mirror assembly 330 comprises a polygon mirror 331 which is provided with a plurality of reflection surfaces, and a driving part 333 to rotate the polygon mirror 331 of a high speed and a uniform velocity.

The plurality of optical holes 340 comprise a cylindrical lens (not illustrated) and a scanning lens (not illustrated). The cylindrical lens (not illustrated) is disposed between the light source part (not illustrated) and the polygon mirror 331 to regulate the light scanned by the light source part (not illustrated) to converge in a sub-scanning direction. The polygon mirror 331 is rotated at a high speed by the driving part 333 to receive the light having passed through the cylindrical lens and reflects the light to form a predetermined angle of view. The scanning lens (not illustrated) regulates the light reflected by the polygon mirror 331 to converge in a main scanning direction. The reflection mirror 360 reflects the light having passed through the scanning lens in a predetermined direction to ultimately form an image on the photosensitive body 111.

Figure 4A:
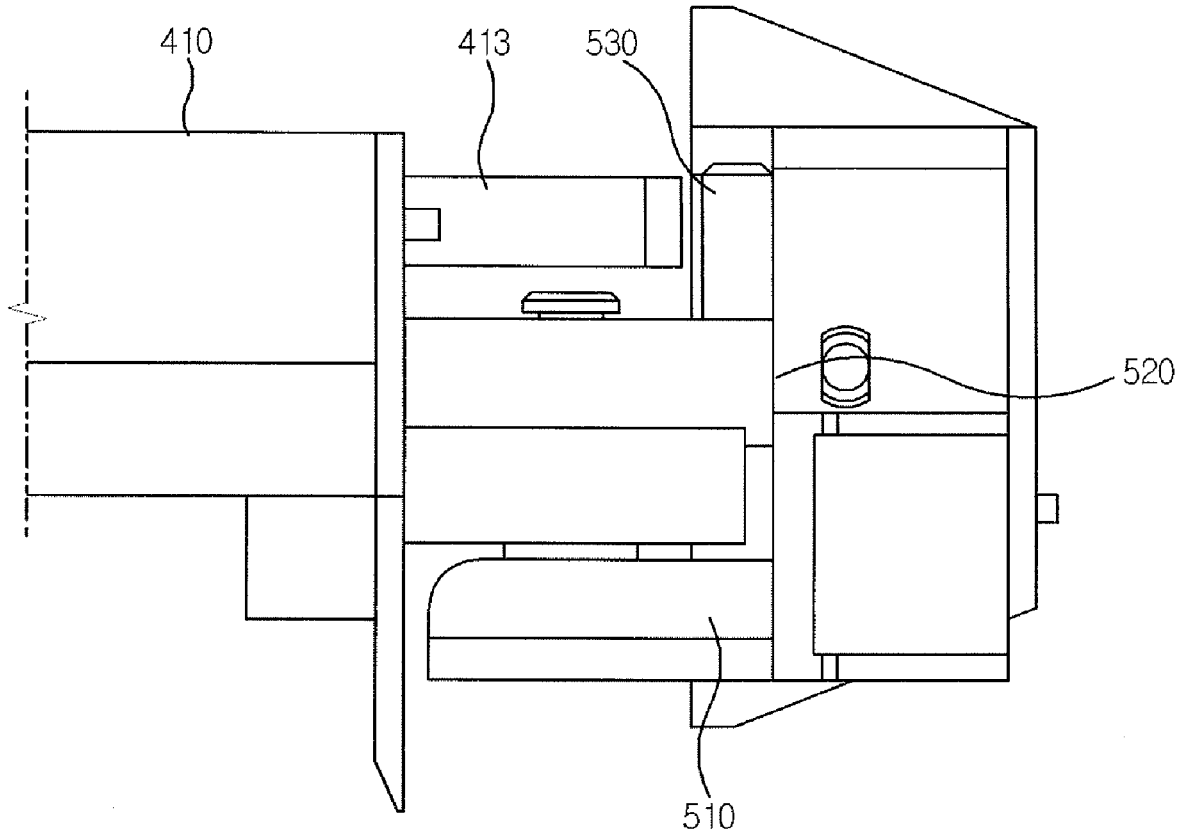
FIGS. 4A and 4B are a sectional view and a perspective view respectively, illustrating a configuration of a cleaning shutter driving part according to an embodiment of the present general inventive concept.
Figure 4B:
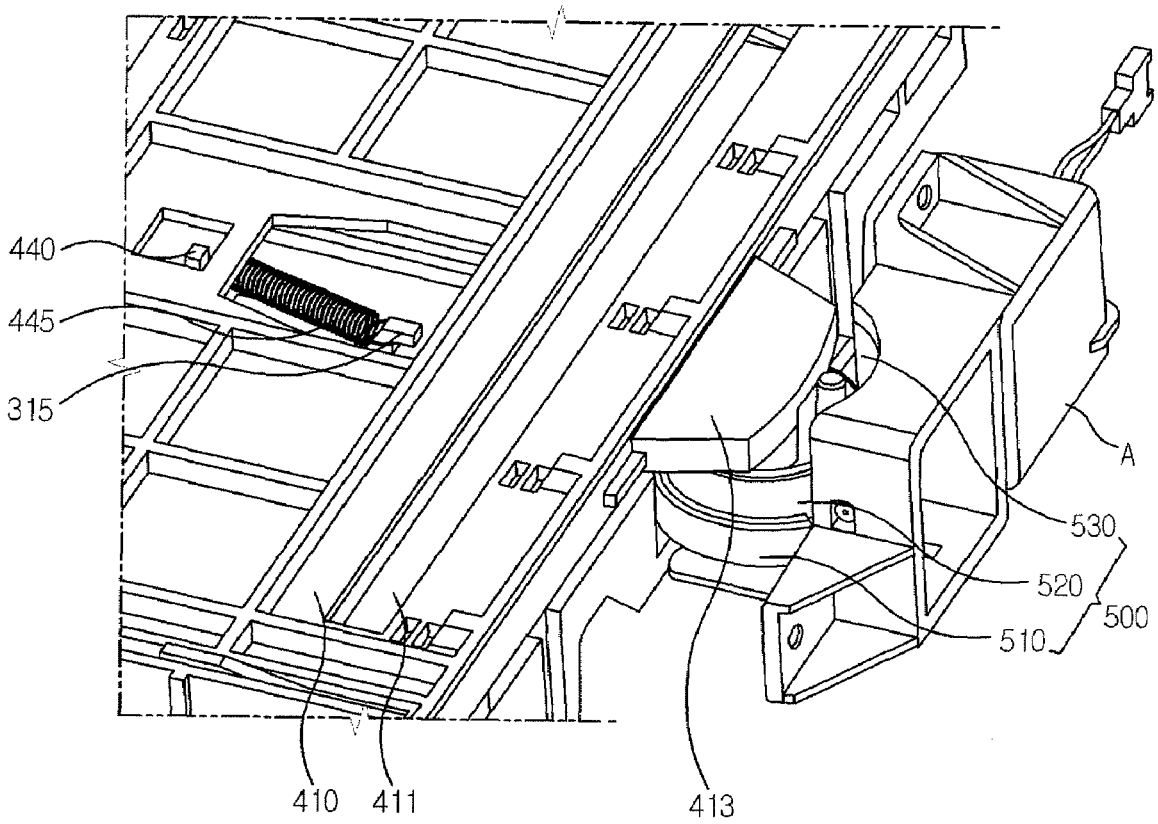
Figure 5A:
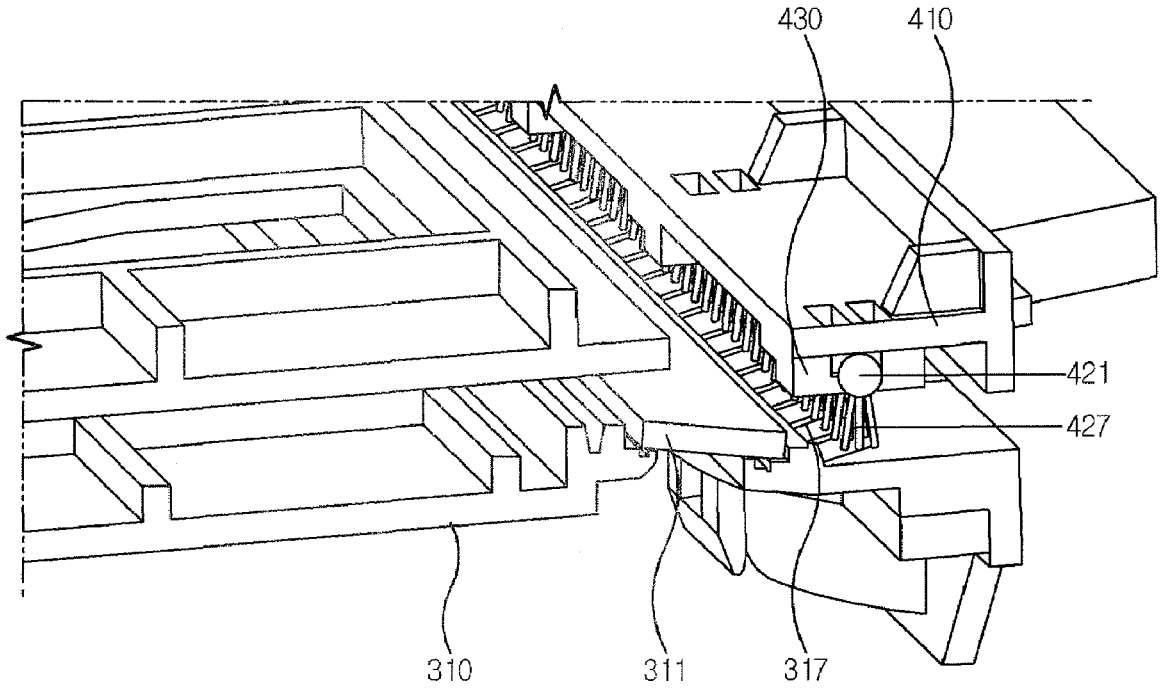
FIGS. 5A and 5B are a perspective view and a sectional view respectively, illustrating a configuration when a cleaning shutter moves from a closing position to an opening position according to an embodiment of the present general inventive concept.
Figure 5B:
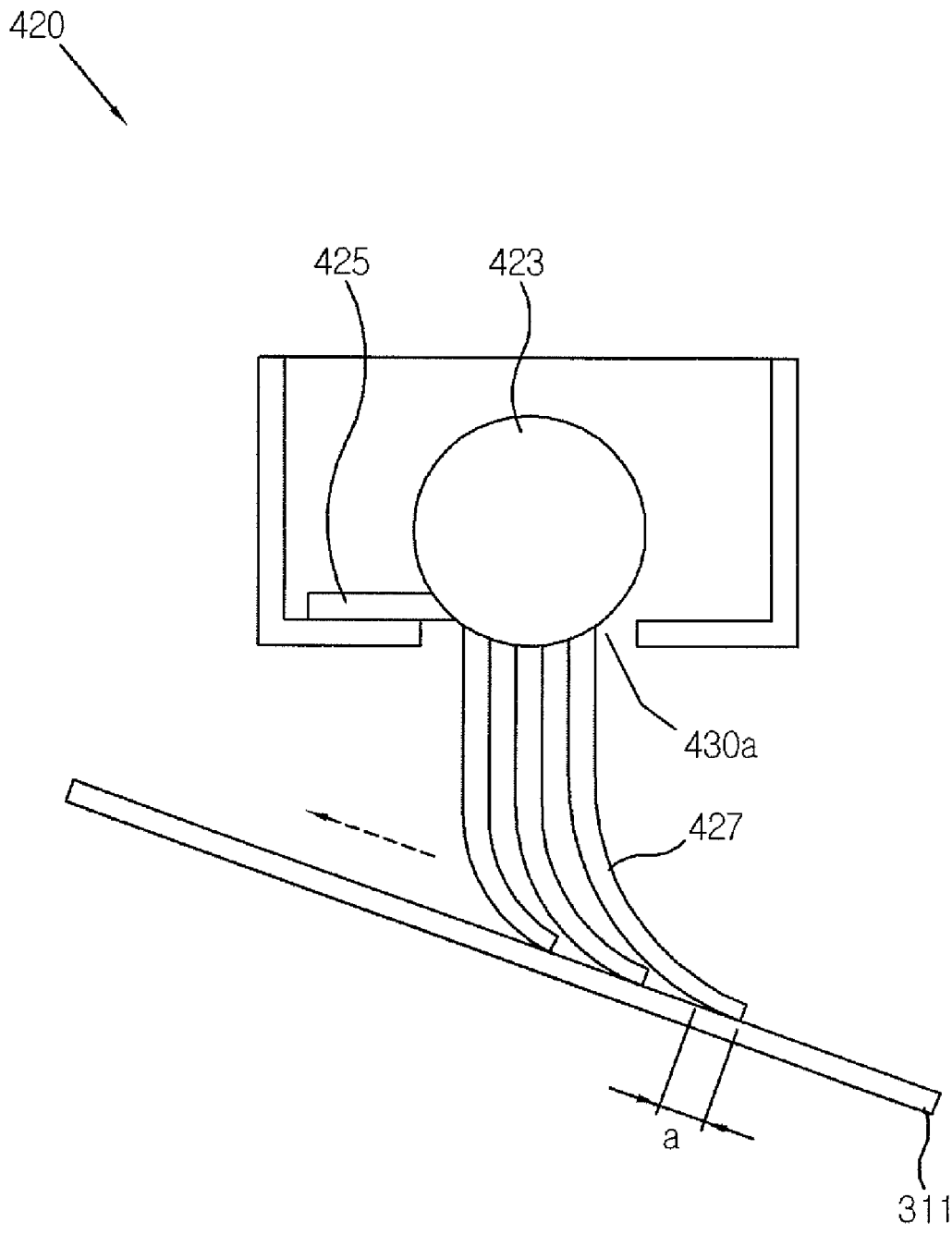

As illustrated in FIG. 3, the casing 310 supports each of the components inside, and comprises the light scanning window 311 to allow the light to penetrate it so that the light reflected from the reflection mirror 360 can face the photosensitive body 111, a shutter coupling boss 313 which is coupled to the cleaning shutter part 400, an elastic member hook 315 to which an elastic member 445 of FIG. 4B is coupled to help the movement of the cleaning shutter part 400, and a cleaning rib part 317 to clean a cleaning member 427 of FIG. 5B of the cleaning shutter part 400.

The light scanning window 311 is provided in a position where the light reflected from the reflection mirror 360 faces the photosensitive body 111. As illustrated in FIG. 2, if the light scanning unit 300 is disposed under the developing unit 110, the light scanning window 311 is provided on an upper surface of the casing 310, and if the light scanning unit 300 is disposed above the developing unit 110, the light scanning window 311 is provided on a lower surface of the casing 310. Also, when the light scanning window 311 has a single-pass type image forming part 100 as in an exemplary embodiment of the present general inventive concept, the light scanning window 311 is provided to correspond to the number of the developing units 110, and when the light scanning window 311 has a multi-pass type image forming part, the light scanning window 311 is provided in fewer numbers than a number of the developing units 110.

A shutter coupling boss 313 is coupled to the cleaning shutter part 400 so that the cleaning shutter part 400 (to be described later) can move between a closing position to close the light scanning window 311 and an opening position to open the light scanning window 311. The shutter coupling boss 313 is accommodated in a guide rail 455 of the cleaning shutter part 400 to support a reciprocating movement of the cleaning shutter part 400. The shutter coupling boss 313 is provided to correspond to a shape and size of the guide rail 455.

The elastic member hook 315 is coupled to the elastic member 445 along with an elastic member coupling part 440 of the cleaning shutter part 400. A detailed description of the elastic member hook 315 will be made along with a description of the elastic member 445.

Figure 6A:
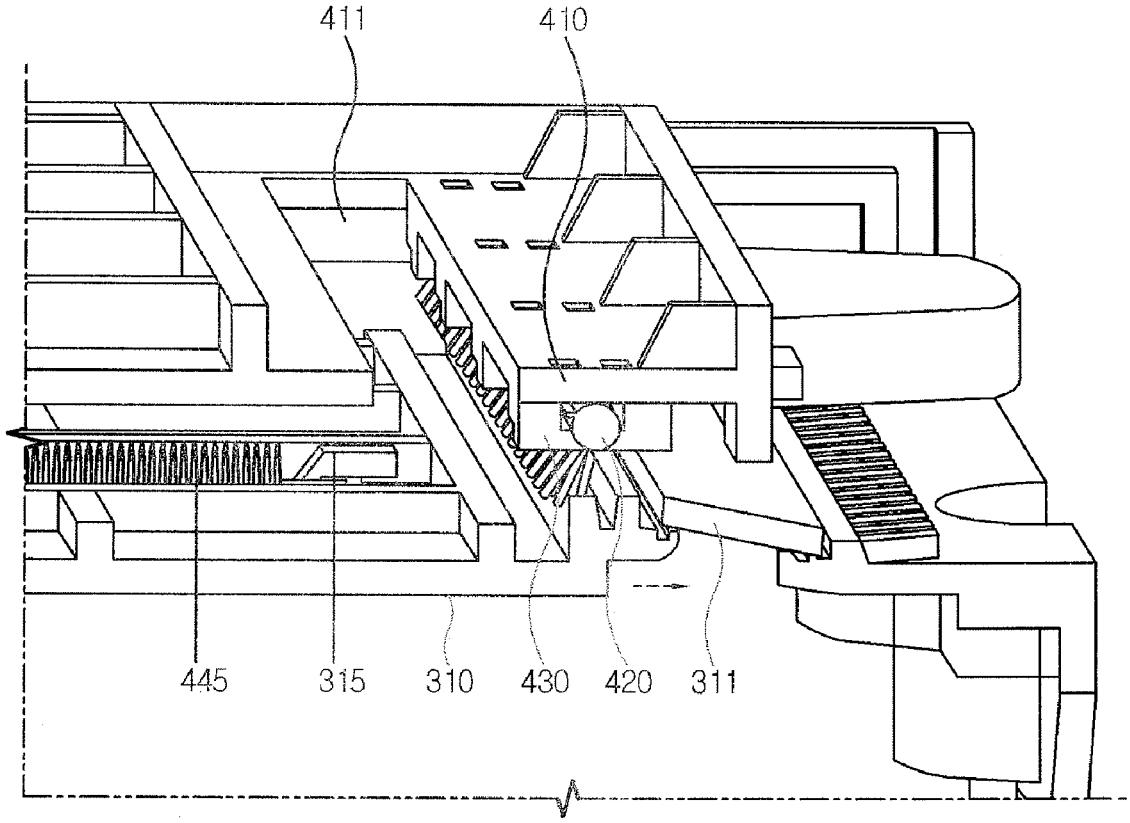
FIGS. 6A and 6B are a perspective view and a sectional view respectively, illustrating a configuration when a cleaning shutter moves from an opening position to a closing position according to an embodiment of the present general inventive concept.

As illustrated in FIG. 6A, the cleaning rib part 317 is provided in a position to correspond to a cleaning member 427 of the cleaning shutter part 400, and cleans a foreign substance on a surface of the cleaning member 427 if the cleaning shutter part 400 is in the closing position. The cleaning rib part 317 comprises a cleaning rib 317*a* which is formed to be projected with respect to a planar surface of the casing 310, and contacts the cleaning member 427.

The cleaning rib 317*a* is provided to have a height high enough to contact the cleaning member 427 by a predetermined length, and enables the foreign substance on the surface of the cleaning member 427 to be separated by interference of an area where the cleaning rib 317*a* contacts with the cleaning member 427 if the cleaning shutter part 400 moves.

Figure 7A:
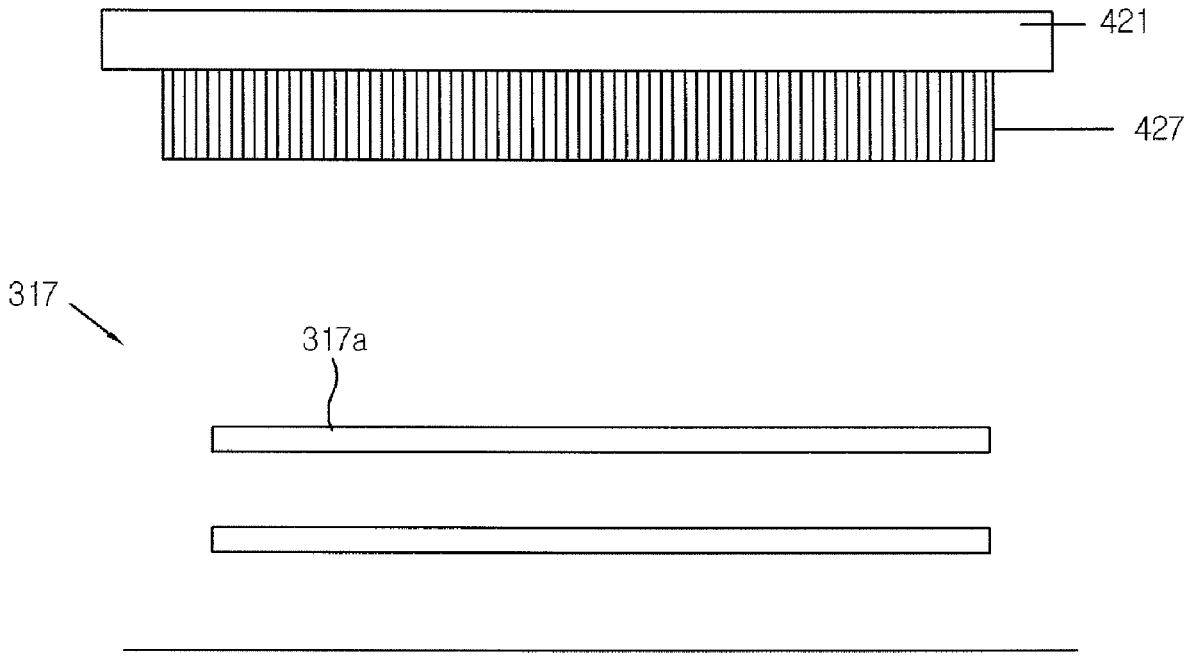
FIGS. 7A to 7C are exemplary views illustrating various exemplary embodiments of a cleaning rib according to an embodiment of the present general inventive concept.
Figure 7B:
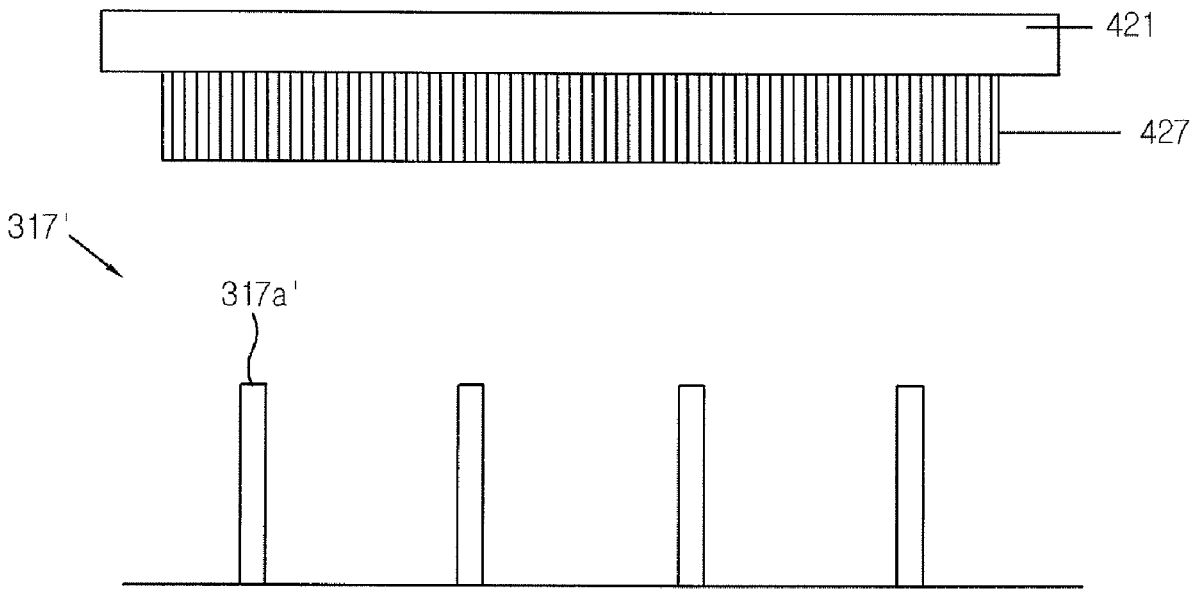
Figure 7C:
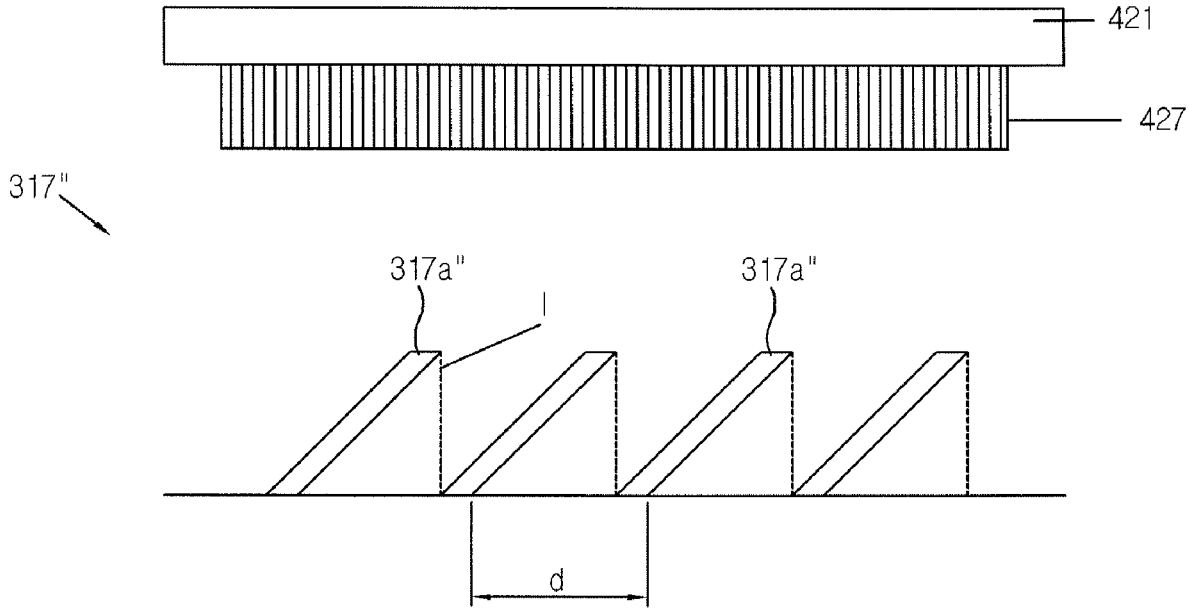

FIGS. 7A through 7C are exemplary views illustrating various exemplary embodiments of the cleaning rib part 317. As illustrated in FIG. 7A, the cleaning rib 317*a* is provided in a vertical direction with respect to the moving direction of the cleaning member 317. Since a contacting area of the cleaning member 427 and the cleaning rib 317*a* is large, a removing effect of the foreign substance can be superior, but since a contacting time of the cleaning rib 317*a* and cleaning member 427 is long, the cleaning member 427 may be easily worn out.

As illustrated in FIG. 7B, a cleaning rib 317*a*' is provided in a parallel direction with respect to the moving direction of the cleaning member 427. Since a contacting time of the cleaning member 427 and the cleaning rib 317' is short, durability of the cleaning member 427 may be longer, but since there is generated an area of the cleaning member 427 which does not contact with the cleaning rib 317*a*', the removing effect of the foreign substance may be deteriorated. However, if the interval between the cleaning ribs 317*a*' is reduced, the removing effect of the foreign substance can be enhanced.

As illustrated in FIG. 7C, the cleaning rib 317*a*" is provided in a diagonal direction with respect to the moving direction of the cleaning member 427. Since a contacting area of the cleaning member 427 and the cleaning rib 317" is large, and a contacting time is short, the removing effect of the foreign substance can be enhanced. Also, if an interval d between the cleaning ribs 317*a*" is provided so that an end part of the cleaning rib 317*a*" can be on a same line 1 as an opposite end part of the adjacent cleaning rib 317*a*", the contacting time can be minimized and the contacting area can be maximized to maximize the removing effect of the foreign substance.

Referring to FIGS. 3 through 5B, the cleaning shutter part 400, according to an embodiment of the present general inventive concept is provided on an optical path of the light scanning unit 300 to move between the closing position to close the light scanning window 311 and the opening position to open the light scanning window 311 of the light scanning unit 300. The cleaning shutter part 400 comprises a shutter main body 410, a cleaning part 420, which is provided on one side of the shutter main body 410 to clean the light scanning window 311 if the shutter main body 410 moves, a cleaning part accommodating part 430 which is provided in a lower side of the shutter main body 410 to rotatably accommodate an area of the cleaning part 420, an elastic member coupling part 440 which is provided in a direction facing the elastic member hook 315 to support the elastic member 445, and a light scanning unit coupling part 450 which is coupled to the light scanning unit 300.

As illustrated in FIGS. 2 and 3, the shutter main body 410 is provided in a position corresponding to the light scanning window 311 of the light scanning unit 300, and can close the light scanning window 311 to block an exposure of the light if a printing signal is not applied. The shutter main body 410 can also open the light scanning window 311 of the light scanning unit 300 to enable the light to be scanned onto the photosensitive body 111 if the printing signal is applied.

The shutter main body 410 comprises a light scanning slit 411 which is formed through the shutter main body 410 in a position corresponding to the light scanning window 311 and through which the light is scanned, and a shutter pressing rib 413 which is provided in one end part of the shutter main body 410 to contact with a cleaning shutter driving part 500 to enable the cleaning shutter part 400 to move between the opening position and the closing position by the cleaning shutter driving part 500. The light scanning slit 411 is provided to correspond to a size and shape of the light scanning window 311.

The shutter pressing rib 413 may be provided in various types according to a driving method and shape of the cleaning shutter driving part 500. As illustrated in FIG. 4B, the shutter pressing rib 413 according to an exemplary embodiment of the present general inventive concept is provided to contact with a gear stud 530 of the cleaning shutter driving part 500 to be pressurized in correspondence with movement of the gear stud 530 according to a rotation of a gear 520, thereby moving the shutter main body 410. Accordingly, the shutter pressing rib 413 is provided in the position corresponding to the gear stud 530 to have a width corresponding to a moving radius of the gear stud 530.

The shutter pressing rib 413 may be assembled with a link member (not illustrated) to transmit a pivotal rotation of a door (not illustrated) to enable the shutter main body 410 to move if the cleaning shutter driving part 500 is provided to move in engagement with the opening and the closing of the door of the image forming apparatus 1.

As illustrated in FIGS. 5A through 6B, the cleaning part 420 is provided on a lower side of the shutter main body 410 to clean the light scanning window 311 if the shutter main body 410 moves. The cleaning part 420 comprises a cleaning main body 421, a rotational shaft 423, which is provided on one side of the cleaning main body 421 to be pivotally and rotatably accommodated in the cleaning part accommodating part 430, and the cleaning member 427 which is coupled to the cleaning main body 421 to clean the surface of the light scanning window 311.

Figure 8A:
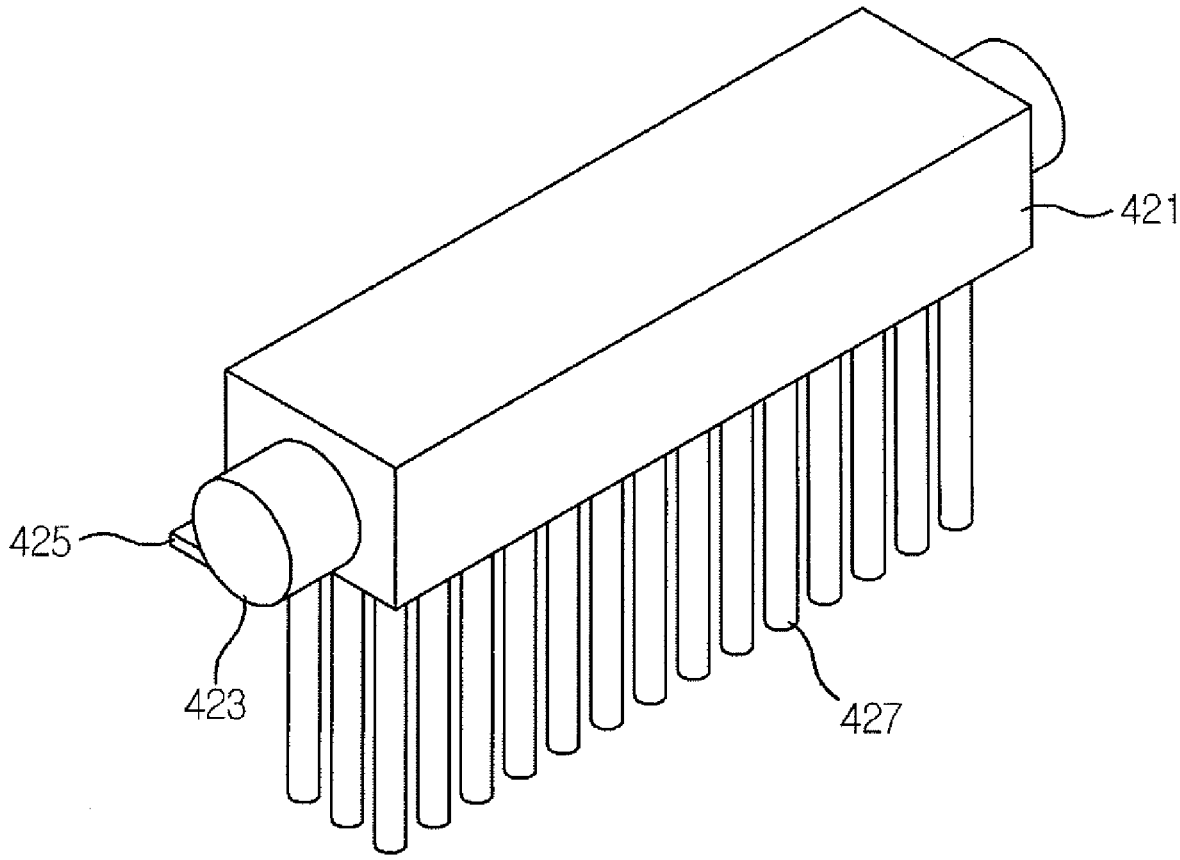
FIGS. 8A and 8B are exemplary views illustrating various exemplary embodiments of a cleaning part according to an embodiment of the present general inventive concept.
Figure 8B:
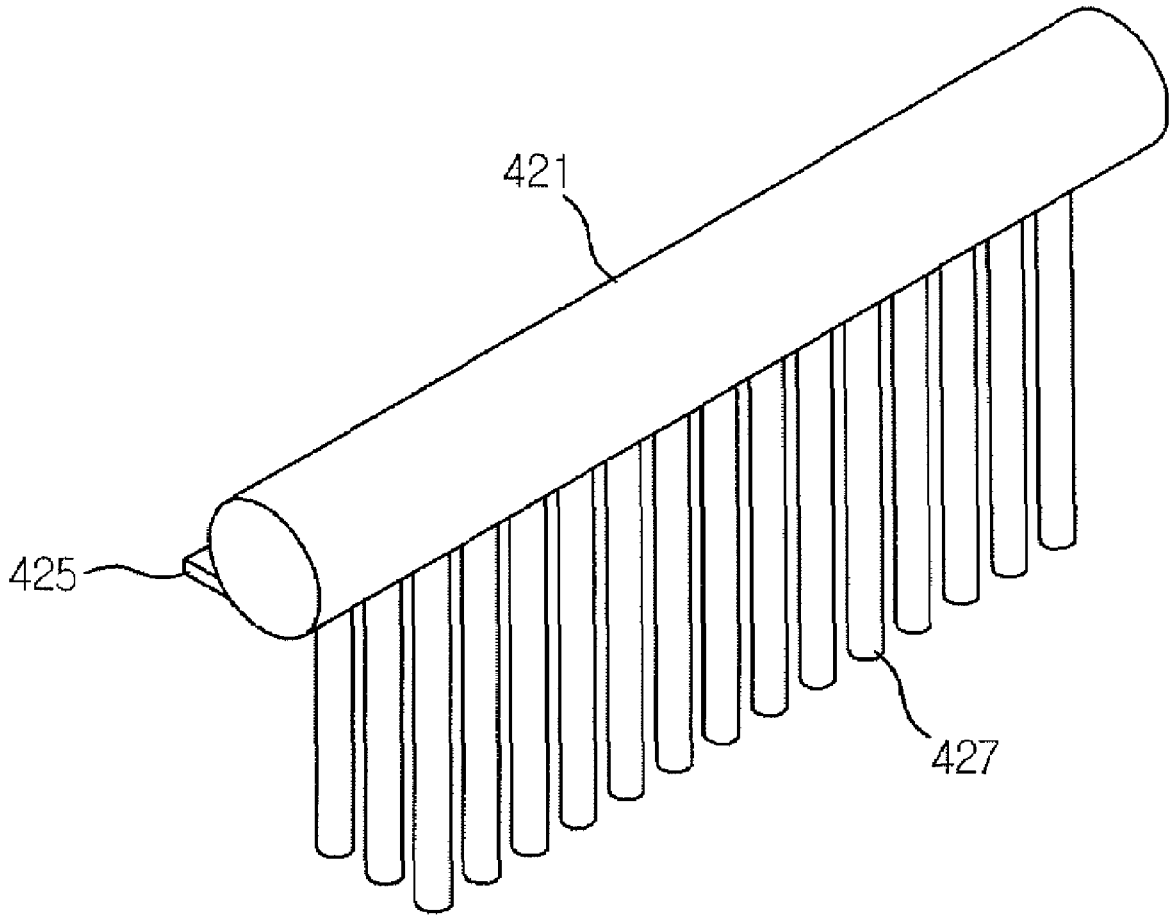

The cleaning main body 421 is coupled to the lower side of the shutter main body 410 to support the cleaning member 427. As illustrated in FIG. 8A, the cleaning main body 421 may be provided in a polygonal shape including a rectangle, or as illustrated in FIG. 8B, the cleaning main body 421 may be provided in a cylindrical shape. Accordingly, if the cleaning main body 421 is provided in the polygonal shape, as illustrated in FIG. 8A, the rotational shaft 423 is provided at opposite end part areas of the cleaning main body 421. Alternatively, if the cleaning main body 421 is provided in the cylindrical shape as illustrated in FIG. 8B, the cleaning main body 421 becomes the rotational shaft 423.

Meanwhile, the rotational shaft 423 includes a supporting projection 425 which is projected along a radiating direction of the rotational shaft 423. The supporting projection 425 contacts an internal wall of the cleaning part accommodating part 430 to block the rotation of the rotational shaft 423 if the shutter main body 410 moves from the closing position to the opening position, and the supporting projection 425 is separated from the internal wall of the cleaning part accommodating part 430 to permit the rotation of the rotational shaft 423 if the shutter main body 410 moves from the opening position to the closing position.

As illustrated in FIG. 5B, the rotational shaft 423 rotates counterclockwise by a rotational moment generated by contact of the cleaning member 427 and the light scanning window 311 if the shutter main body 410 moves from the closing position to the opening position, as illustrated by an arrow in FIG. 5B. Accordingly, the supporting projection 425 contacts the internal wall of the cleaning part accommodating part 430 to support the rotational shaft 423 and to prevent the rotational shaft 423 from rotating further. Accordingly, since the shutter main body 410 moves in a state in which a contacting area 'a' between the cleaning member 427 and the light scanning window 311 is maximized, a frictional force between the cleaning member 427 and the light scanning window 311 also becomes maximized. Accordingly, cleaning efficiency to expel the foreign substance from the surface of the light scanning window 311 can be maximized.

Figure 6B:
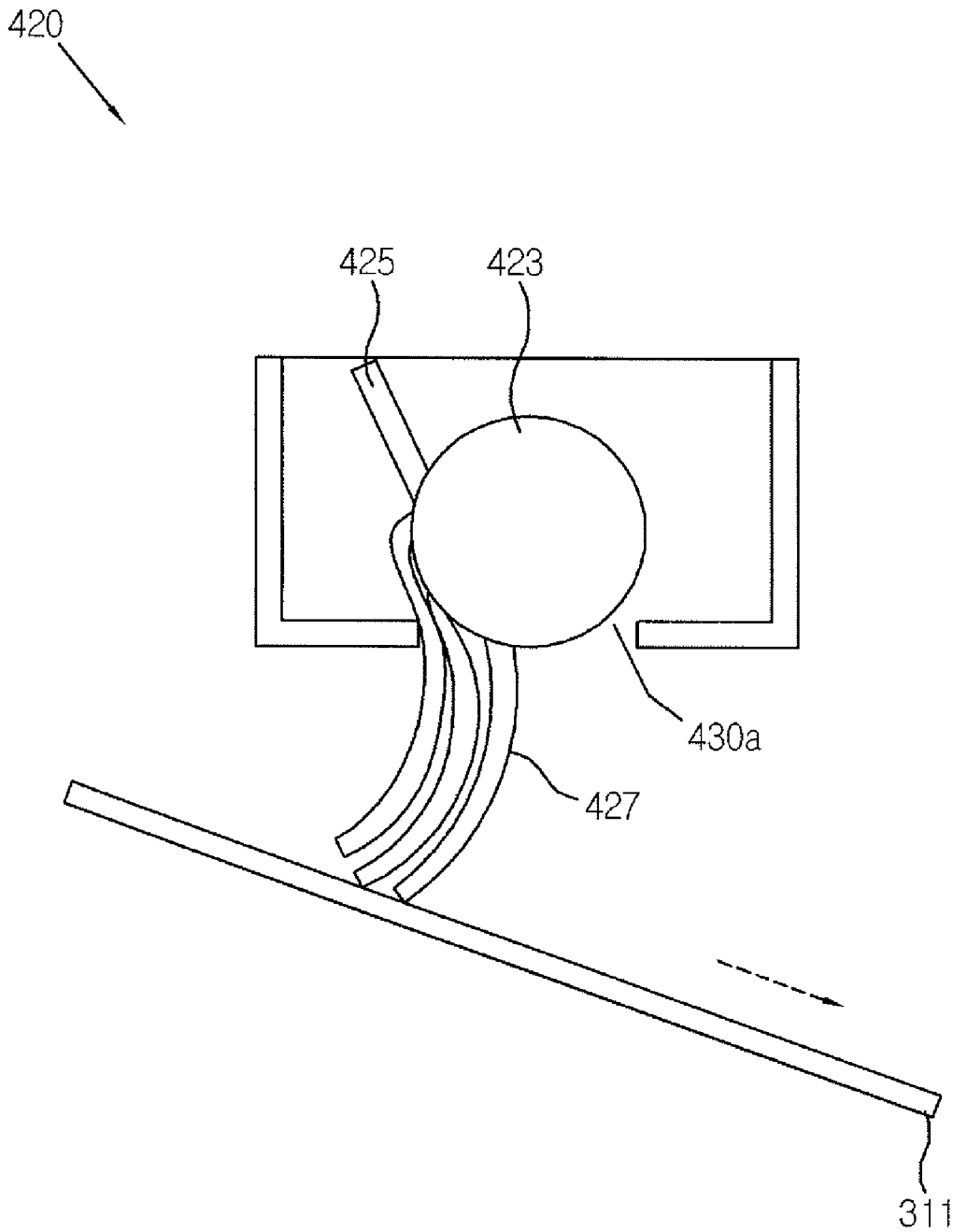

As illustrated in FIG. 6B, the rotational shaft 423 pivotally rotates clockwise by the rotational moment generated by the contact of the cleaning member 427 and the light scanning window 311 if the shutter main body 410 moves from the opening position to the closing position. At this time, the supporting projection 425 is separated from the internal wall of the cleaning part accommodating part 430 to enable the rotational shaft 423 to be capable of rotating. As the rotational shaft 423 rotates clockwise, the cleaning member 427 is inserted inside an opening 430*a* during the rotation, thereby minimizing a contacting area with the light scanning window 311. Accordingly, the frictional force between the cleaning member 427 and the light scanning window 311 can be minimized.

Meanwhile, as illustrated in FIG. 6B, when the rotating shaft 423 rotates clockwise, the length of the supporting projection 425 may be provided to have a length to be supported on an opposite side of the internal wall so that a rotational angle from the position in which the supporting projection 425 has been contacted with the internal wall, as illustrated in FIG. 5B, cannot exceed 90°. Accordingly, an area where the cleaning member 427 is inserted into the inside of the cleaning part accommodating part 430 is minimized. Also, the supporting projection 425 may be provided adjacent to the coupling position of the cleaning member 427 and the cleaning main body 421 to minimize the contacting area of the cleaning member 427 and the light scanning window 311 when the shutter main body 410 moves from the opening position to the closing position.

The cleaning member 427 is extended from the cleaning main body 421 to contact with the light scanning window 311 and to clean the foreign substance of the surface of the light scanning window 311. The cleaning member 427 may be provided as a member capable of generating a frictional force with the light scanning window 311 while moving. The cleaning member 427 may be provided as a brush shape, a sponge type, and a combination of plural fibers. The length of the cleaning member 427 may be provided so that contacting area with the light scanning window 311 can be maximum if the shutter main body 410 moves from the closing position to the opening position, and it may be provided to be inserted into the cleaning part accommodating part 430 by the rotation of the rotational shaft 423 so that the contacting area with the light scanning window 311 can be minimized if the shutter main body 410 moves from the opening position to the closing position.

The cleaning member 427 may be provided not to have a contacting area with the light scanning window 311 if the shutter main body 410 moves from the opening position to the closing position considering the diameter of the rotational shaft 423 and the position of the supporting projection 425.

The cleaning shutter part 400 has been described corresponding to a configuration where the cleaning shutter part 400 is provided above the light scanning unit 300 as a reference in an exemplary embodiment of the present general inventive concept, and the rotational direction of the rotational shaft 423 can be changed according to the position of the light scanning unit 300 and the cleaning shutter part 400.

The elastic member coupling part 440 supports the elastic member 445 along with the elastic member hook 315 of the light scanning unit 300. The elastic member coupling part 440 and the elastic member hook 315 support an end part and an opposite end part of the elastic member 445, respectively, and supply a frictional force so that the shutter main body 410 can move to the closing position at a high speed if the shutter main body 410 moves from the opening position to the closing position.

As illustrated in FIG. 4B, the elastic member 445 is disposed between the elastic member coupling part 440 and the elastic member hook 315 by an initial length if the shutter main body 410 is in the closing position. If the gear stud 530 pressurizes the shutter pressing rib 413 by the rotation of the gear 520 and the shutter main body 410 moves, the elastic member coupling part 440 moves according to the movement of the shutter main body 410. Accordingly, the elastic member 445 gets elastically expanded.

If the printing signal is removed in the opening position, a motor 510 rotates and the pressure of the gear stud 530 which has pressurized the shutter pressing rib 413 disappears. Accordingly, the elastic member 445 operates on an elastic force so as to return to the initial position, and the shutter main body 410 moves to the closing position at a high speed by the elastic force. Accordingly, since the frictional force between the cleaning member 427 and the light scanning window 311 becomes minimized to produce no force to resist the elastic force, the shutter main body 410 can move by a minimum force. Here, the returning speed of the shutter main body 410 can be regulated by an elastic coefficient of the elastic member 445.

The cleaning shutter driving part 500 moves the cleaning shutter part 400 from the closing position to the opening position according to a control signal of a controller (not illustrated) if the printing signal is applied. The cleaning shutter driving part 500 comprises the motor 510 which rotates according to the control signal of the controller (not illustrated), the gear 520 which rotates in engagement with the motor 510, and the gear stud 530 which is coupled to the gear 520 and converts the rotational movement of the gear 520 into a linear movement of the shutter main body 410.

In general, a DC motor can be used for the motor 510, and the gear 520 is used as a unit to transmit the rotational force of the motor 510. However, other driving means can be used to transmit the rotational force of the motor 510 in addition to the gear 520. The gear stud 530 moves along a rotational radius of the gear 520 according to the rotation of the gear 520. Accordingly, the gear stud 530 contacts with the shutter pressing rib 413 of the shutter main body 410 and transmits the rotational force of the gear 520 to enable the shutter main body 410 to move from the closing position to the opening position.

The moving radius of the gear stud 530 corresponds to the rotational radius of the gear 520. Also, the moving radius of the gear stud 530 corresponds to the moving distance of the shutter main body 410.

Figure 9:
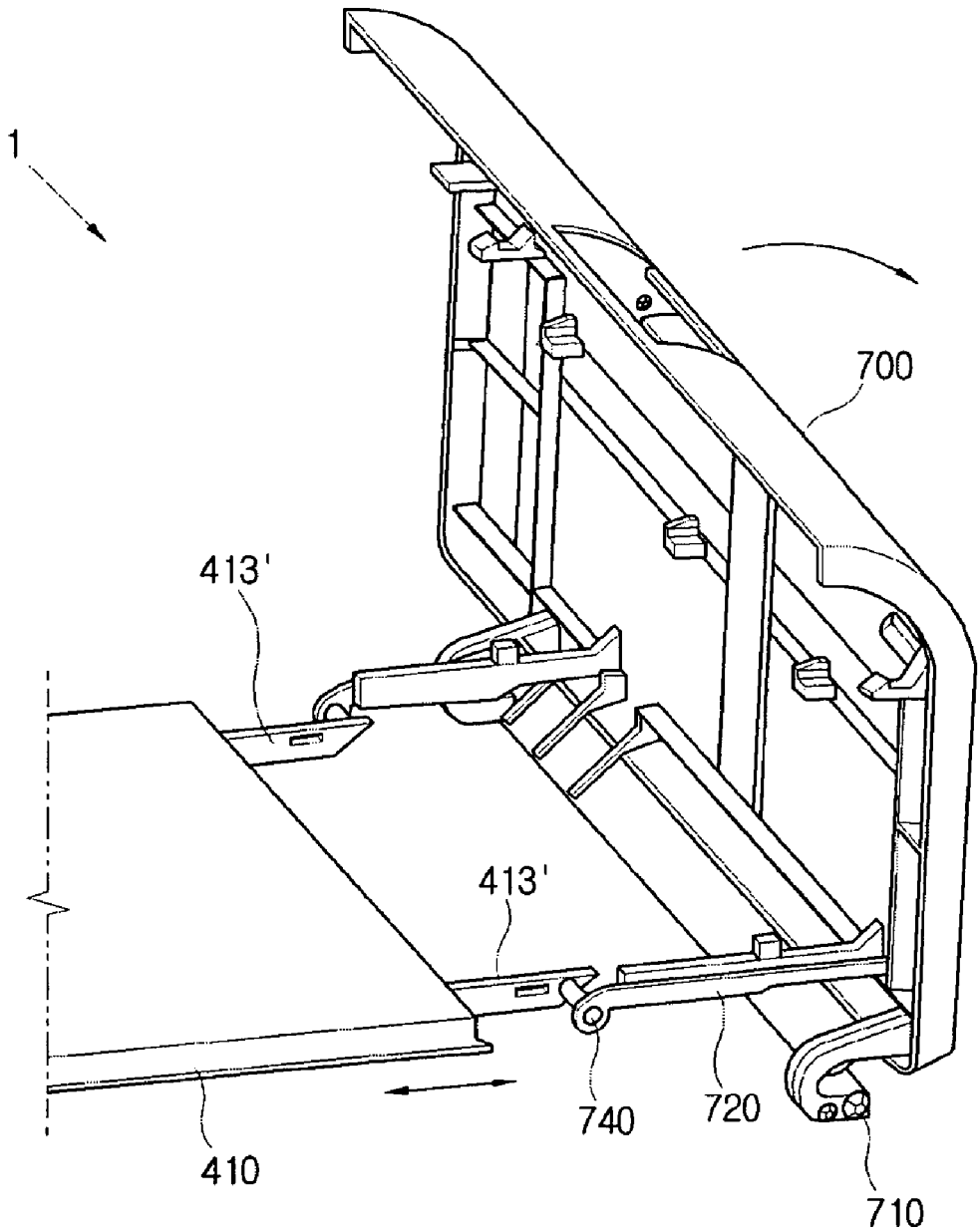
FIG. 9 is a perspective view illustrating a configuration of an image forming apparatus according to a second exemplary embodiment of the present general inventive concept.

As illustrated in FIG. 9, the cleaning shutter driving part 500 may be provided as a link member 720 assembled with a door 700 in the image forming apparatus 1 according to another exemplary embodiment of the present general inventive concept. A door hinge 710 allows the door 700 to open and close. If the door 700 is closed, the shutter main body 410 is in the opening position. Also, if the door 700 is opened from the main body, the shutter main body 410 moves to the closing position. For this purpose, the link member 720 and the shutter main body 410 are coupled by a shutter coupling part 413', and between the shutter coupling part 413' and the link member 720, a hinge shaft 740 is provided to help a linear movement of the shutter main body 410.

A configuration to clean the light scanning window 311 of the image forming apparatus 1 with this configuration according to an embodiment of the present general inventive concept will be described by referring to FIGS. 2 to 6B.

First, if the printing signal is applied, the controller (not illustrated) supplies power to the motor 510. The gear stud 530 moves according to the rotation of the motor 510 to pressurize the shutter pressing rib 413.

As illustrated in FIG. 5A, the shutter main body 410 in the closing position moves to the opening position by the pressure of the shutter pressing rib 413. Accordingly, the cleaning member 427 contacts with the cleaning rib 317*a* to clean a pollutant such as developer adhered to the brush or the sponge of the cleaning member 427. The cleaned cleaning member 427 contacts with the light scanning window 311 to clean the surface of the light scanning window 311 by the rotation-frictional force.

Accordingly, the rotational shaft 423 rotates counterclockwise by the rotational moment generated by the contact of the light scanning window 311 and the cleaning member 427, and the supporting projection 425 is supported on the internal wall of the cleaning part accommodating part 430 to block the rotation of the rotational shaft 423. If the rotation of the rotational shaft 423 is blocked, the cleaning member 427 moves while maintaining a maximum contacting area 'a' with the light scanning window 311. That is, the cleaning member 427 maintains the maximal frictional force to clean the light scanning window 311.

Meanwhile, after the shutter main body 410 moves to the opening position, the shutter main body 410 maintains the opening position by the pressure of the gear stud 530, and the image forming part 100 forms an image on the printing medium.

If the image forming is completed, the motor 510 re-rotates and the gear stud 530 rotates to remove the pressure with respect to the shutter pressing rib 413. Accordingly, the elastic member 445 expanded from the initial length between the elastic member coupling part 440 and the elastic member hook 315 applies an elastic force to the shutter main body 410 so as to return to the initial length.

As illustrated in FIG. 6B, if the shutter main body 410 moves from the opening position to the closing position, the supporting projection 425, which is contact-supported on the internal wall of the cleaning part accommodating part 430, is separated from the internal wall, and accordingly, the rotational shaft 423 is in a rotatable state. The rotational shaft 423 pivotally rotates clockwise by the rotational moment generated by the frictional force between the cleaning member 427 and the light scanning window 311, and the cleaning member 427 is rolled along the opening part 430*a*. Hence, the contacting area between the cleaning member 427 and the light scanning window 311 becomes minimized.

Accordingly, a resisting force generated between the light scanning window 311 and the cleaning member 427 becomes minimized with respect to a restoring force in which the elastic member 445 restores the shutter main body 410 to the closing position, so that the shutter main body 410 can rapidly move.

A cleaning shutter according to the above-described exemplary embodiment of the present general inventive concept has a configuration to clean a light scanning window if a shutter main body moves from a closing position to an opening position, but a large frictional force may be applied to clean the light scanning window if the shutter main body moves from the opening position to the closing position, and a small frictional force may be applied if the shutter main body moves from the closing position to the opening position, as necessary.

As described above, the present general inventive concept provides a light scanning module to regulate an interfering amount between a cleaning member and a light scanning window to improve a returning speed of a cleaning-completed cleaning shutter, and the image forming apparatus having the light scanning module.

Also, a cleaning rib is provided to remove a foreign substance of the cleaning member in the light scanning unit to maintain and control the cleaning member cleanly, thereby improving its durability.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the

What is claimed is:

1. A light scanning module mounted on a main body, the module comprising:

a light scanning unit including a light scanning window to scan a light onto a photosensitive body of the main body; and a cleaning shutter part coupled to the main body to move between an opening position to open the light scanning window and a closing position to close the light scanning window, the cleaning shutter part comprising:

a cleaning part to clean the light scanning window, a cleaning part accommodating part to accommodate at least one area of the cleaning part to pivotally rotate, and a rotation regulating part provided on one side of the cleaning part and is contact-supported on an internal wall of the cleaning part accommodating part to block the pivotal rotation of the cleaning part if the cleaning shutter part moves from the closing position to the opening position, and is separated from the internal wall of the cleaning part accommodating part to permit the pivotal rotation of the cleaning part if the cleaning shutter part moves from the opening position to the closing position.

2. The light scanning module according to claim 1, wherein the cleaning part comprises:

a cleaning part main body of which one area is rotatably accommodated in the cleaning part accommodating part; and a cleaning member provided in a lower part of the cleaning part main body and is interfered with the light scanning window to clean a surface of the light scanning window.

3. The light scanning module according to claim 2, wherein the rotation regulating part comprises:

a rotating shaft provided in the cleaning part main body and accommodated in the cleaning part accommodating part; and a supporting projection projected in an area of a radiating direction of the rotating shaft, and is contacted with and separated from the internal wall of the cleaning part accommodating part according to the movement of the cleaning shutter part.

4. The light scanning module according to claim 3, wherein the cleaning part main body and the rotating shaft are provided to be integrated with each other.

5. The light scanning module according to claim 3, wherein the supporting projection is provided to have a length to contact with an opposite wall of the cleaning part accommodating part so that an angle in which a rotation of the rotational shaft is permitted from a position where the rotational shaft is rotation-blocked by the supporting projection is 90° or less.

6. The light scanning module according to claim 2, wherein the cleaning part accommodating part comprises:

an opening to expose the cleaning member.

7. The light scanning module according to claim 1, wherein the cleaning member is provided as one of a sponge, a brush, a fiber, and an elastic member.

8. The light scanning module according to claim 1, wherein the light scanning unit comprises:

a cleaning rib to contact the cleaning member and to clean the cleaning member if the cleaning shutter part is in the closing position.

9. The light scanning module according to claim 8, wherein the cleaning rib is disposed in a diagonal direction with respect to the moving direction of the cleaning shutter.

10. The light scanning module according to claim 9, wherein:

the cleaning rib is provided plurally; and each interval among the plural cleaning ribs is provided so that a line according to the moving direction of the cleaning shutter can be on a line linking an end part of a first cleaning rib and an opposite end part of a second cleaning rib adjacent to the first cleaning rib.

11. The light scanning module according to claim 8, wherein the cleaning rib is provided to be parallel or transverse with respect to the moving direction of the cleaning shutter.

12. An image forming apparatus, comprising:

a main body;

an image forming part provided in the main body and has a photosensitive body to spread developer on a printing medium;

a light scanning module to scan a light onto the photosensitive body, comprising:

a light scanning unit including a light scanning window to scan a light onto a photosensitive body of the main body, a cleaning shutter part coupled to the main body to move between an opening position to open the light scanning window and a closing position to close the light scanning window, the cleaning shutter part comprising:

a cleaning part to clean the light scanning window, a cleaning part accommodating part to accommodate at least one area of the cleaning part to pivotally rotate, and a rotation regulating part provided on one side of the cleaning part and is contact-supported on an internal wall of the cleaning part accommodating part to block the pivotal rotation of the cleaning part if the cleaning shutter part moves from the closing position to the opening position, and is separated from the internal wall of the cleaning part accommodating part to permit the pivotal rotation of the cleaning part if the cleaning shutter part moves from the opening position to the closing position; and a feeding part to feed a printing medium to the image forming part.

13. The image forming apparatus according to claim 12, wherein the main body comprises:

a driving part to apply a driving force to the cleaning shutter so that the cleaning shutter can move between the opening position and the closing position.

14. The image forming apparatus according to claim 13, wherein the driving part comprises:

a rotation driving part to transmit a driving force generated in the driving force generating part; and a movement converting part to convert the rotating movement of the rotation driving part into a linear movement of the cleaning shutter.

15. The image forming apparatus according to claim 14, wherein:

the rotation driving part is provided as a gear; and the movement converting part is provided as a gear stud which is coupled to the rotation driving part to contact-pressurize the cleaning shutter.

16. The image forming apparatus according to claim 12, wherein:

the main body comprises a casing, and a door which is provided in the casing to pivotally rotate; and the cleaning shutter is coupled to the door so as to move between the opening position and the closing position in engagement with the rotating movement of the door.

17. The image forming apparatus according to claim 16, further comprising:

a link member provided between the door and the cleaning shutter to convert the rotating movement of the door into a linear movement of the cleaning shutter.

18. The image forming apparatus according to claim 12, wherein the light scanning unit comprises:

a cleaning rib to contact the cleaning member and to clean the cleaning member if the cleaning shutter part is in the closing position.

* * * * *